US007462431B2

(12) United States Patent
Chen et al.

(10) Patent No.: US 7,462,431 B2
(45) Date of Patent: Dec. 9, 2008

(54) PHOTORECEPTORS

(75) Inventors: Cindy C. Chen, Rochester, NY (US); Lanhui Zhang, Webster, NY (US); Nancy Lynn Belknap, Rochester, NY (US); Ed J. Radigan, Scottsville, NY (US)

(73) Assignee: Xerox Corporation, Stamford, CT (US)

( * ) Notice: Subject to any disclaimer, the term of this patent is extended or adjusted under 35 U.S.C. 154(b) by 432 days.

(21) Appl. No.: 11/128,006

(22) Filed: May 12, 2005

(65) Prior Publication Data

US 2006/0257768 A1 Nov. 16, 2006

(51) Int. Cl.
*G03G 5/00* (2006.01)

(52) U.S. Cl. ..... 430/58.8; 430/56; 430/59.1; 430/96; 430/133

(58) Field of Classification Search ..... 430/58.8, 430/56, 59.1, 96, 133
See application file for complete search history.

(56) References Cited

U.S. PATENT DOCUMENTS 4,265,990 A 5/1981 Stolka et al.
4,286,033 A 8/1981 Neyhart et al.
4,291,110 A 9/1981 Lee
4,338,387 A 7/1982 Hewitt
4,346,158 A 8/1982 Pai et al.
4,654,284 A 3/1987 Yu et al.
5,473,064 A 12/1995 Mayo et al.
5,521,306 A 5/1996 Burt et al.
5,725,985 A 3/1998 Nealey et al.
5,891,594 A * 4/1999 Yuh et al. ..... 430/71
6,017,666 A 1/2000 Nealey et al.
6,156,468 A 12/2000 Wehelie et al.
6,177,219 B1 1/2001 Yuh et al.
6,255,027 B1 7/2001 Wehelie et al.
6,790,573 B2 9/2004 Drappel et al.
6,800,411 B2 10/2004 Tong et al.
6,818,366 B2 11/2004 Qi et al.
6,824,940 B2 11/2004 Wu et al.
2003/0175605 A1* 9/2003 Katayama et al. ..... 430/59.4
2004/0053152 A1* 3/2004 Nagai et al. ..... 430/96
2004/0115546 A1 6/2004 Tong et al.
2004/0161683 A1* 8/2004 Wu et al. ..... 430/59.1
2005/0196690 A1* 9/2005 Kinomoto ..... 430/58.05

* cited by examiner

*Primary Examiner*—Mark A Chapman
(74) *Attorney, Agent, or Firm*—Carter, DeLuca, Farrell & Schmidt, LLP

(57) ABSTRACT

Photogenerating layers of photoreceptors are provided utilizing a photogenerating component/resin dispersion formed in a low boiling point solvent.

26 Claims, 2 Drawing Sheets

PHOTORECEPTORS

BACKGROUND

The present disclosure relates to imaging members and, more specifically, to photogenerating layers suitable for use with such imaging members.

In the art of electrophotography, an electrophotographic member having a photoconductive insulating layer on a conductive layer is imaged by first uniformly electrostatically charging the surface of the photoconductive insulating layer. The member is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example, from a developer composition, on the surface of the photoconductive insulating layer. The resulting visible toner image can be transferred to a suitable receiving member, such as paper. This imaging process may be repeated many times with reusable electrophotographic imaging members.

The electrophotographic imaging members, i.e., photoreceptors, may be in the form of plates, drums, flexible belts, etc. Electrophotographic photoreceptors may be prepared using either a single layer configuration or a multilayer configuration, but the multilayer arrangement is more common. Multilayered photoreceptors may include a substrate, a conductive layer, an optional hole blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL).

One type of multilayered photoreceptor has a layer of finely divided particles of a photoconductive inorganic compound dispersed in an electrically insulating organic resin. In U.S. Pat. No. 4,265,990, the disclosure of which is incorporated herein by this reference, a layered photoreceptor is disclosed having separate charge generation (photogenerating) layers and charge transport layers. The photogenerating layer is capable of photogenerating hole-electron pairs and injecting the photogenerated holes into the charge transport layer.

Dispersions utilized for forming photogenerating layers for photoreceptors prepared by dip coating processes frequently utilize high boiling point solvent systems, such as n-butyl acetate, xylene, or cyclohexanone. Methods for applying photogenerating layers utilizing these dispersions often do not include a drying step as the drying of any layer introduces extra cost, extra processing time, and possible defects in the production of the photoreceptor.

Other multi-layer photoreceptors include a photogenerating layer, a charge transport layer, and an overcoat layer. An example of such a photoreceptor is disclosed in U.S. Pat. No. 6,824,940, the contents of which are incorporated by reference herein. Such an overcoat layer may assist in extending the life of the photoreceptor by improving its wear resistance. However, in forming a photoreceptor which has an overcoat layer, it may be necessary to dry the photogenerating layer prior to application of any overcoat layer, as it is difficult to remove the solvent in a final drying step after application of an overcoat layer. Moreover, any solvent utilized in applying the photogenerating layer could penetrate through the upper layers thereby causing defects in the photoreceptor.

The cost to prepare photoreceptors increases with each step added to the manufacturing process. Improved methods for forming photoreceptors, including photogenerating layers used therein, are thus desirable.

SUMMARY

The present disclosure provides photoreceptors possessing photogenerating layers of a resin, a photogenerating component, and a low boiling point solvent. In embodiments the low boiling point solvent may be combined with a high boiling point solvent.

Methods for fabricating photogenerating layers of photoreceptors are also provided which include contacting a resin, a photogenerating component and a low boiling point solvent having a boiling point of from about 35° C. to about 100° C. to form a dispersion, and applying the dispersion to a substrate.

The present disclosure also provides, in embodiments, photoreceptors including a photogenerating layer of, for example, about 15 weight percent to about 95 weight percent of a resin, about 5 weight percent to about 85 weight percent of a photogenerating component, and a low boiling point solvent having a boiling point of, for example, from about 35° C. to about 100° C.

BRIEF DESCRIPTION OF THE DRAWINGS

Various embodiments of the present disclosure will be described herein below with reference to the figures wherein.

EMBODIMENTS

Figure 1:
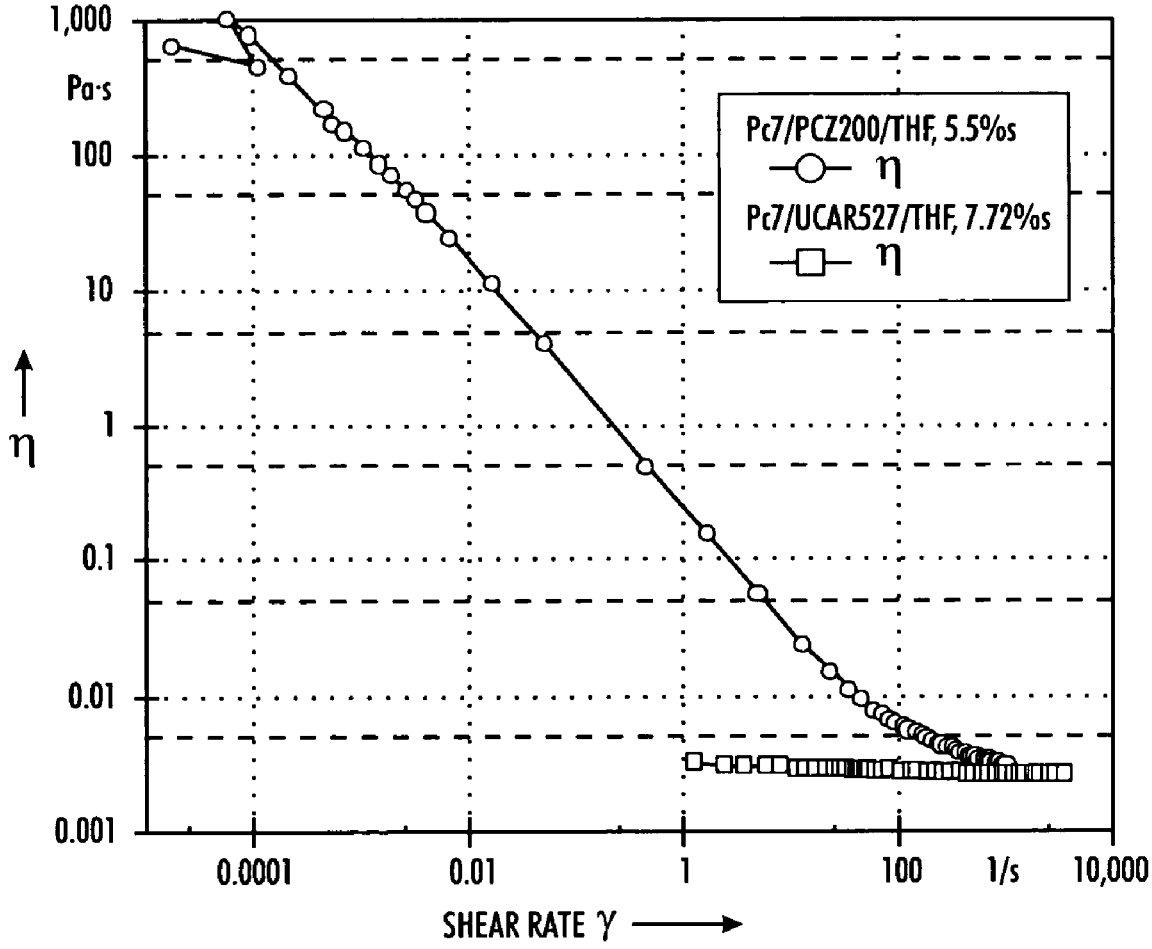
FIG. 1 is a graph depicting the rheological properties of some dispersions of the present disclosure compared with a control.

The present disclosure provides a dispersion for use in forming a photogenerating layer of a photoreceptor. The dispersion includes a film forming resin, a photogenerating component, and a low boiling point solvent which ensures efficient solvent evaporation during the application of the photogenerating layer. The dispersions also possess stable rheological properties to ensure the development of a high quality coating upon application of the dispersion to form a photogenerating layer of a photoreceptor.

Any suitable film forming polymer or combination of film forming polymers can be utilized as the resin to form the dispersion. Examples of suitable resins for use in the dispersion include thermoplastic and thermosetting resins such as polycarbonates, polyesters including poly(ethylene terephthalate), polyurethanes including poly(tetramethylene hexamethylene diurethane), polystyrenes including poly(styrene-co-maleic anhydride), polybutadienes including polybutadiene-graft-poly(methyl acrylate-co-acrylontrile), polysulfones including poly(1,4-cyclohexane sulfone), polyarylethers including poly(phenylene oxide), polyarylsulfones including poly(phenylene sulfone), polyethersulfones including poly(phenylene oxide-co-phenylene sulfone), polyethylenes including poly(ethylene-co-acrylic acid), polypropylenes, polymethylpentenes, polyphenylene sulfides, polyvinyl acetates, polyvinylbutyrals, polysiloxanes including poly(dimethylsiloxane), polyacrylates including poly(ethyl acrylate), polyvinyl acetals, polyamides including poly(hexamethylene adipamide), polyimides including poly (pyromellitimide), amino resins including poly(vinyl amine), phenylene oxide resins including poly(2,6-dimethyl-1,4-phenylene oxide), terephthalic acid resins, phenoxy resins including poly(hydroxyethers), epoxy resins including poly ([(o-cresyl glycidyl ether)-co-formaldehyde], phenolic resins including poly(4-tert-butylphenol-co-formaldehyde), polystyrene and acrylonitrile copolymers, polyvinylchlorides, polyvinyl alcohols, poly-N-vinylpyrrolidinones, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like, and combinations thereof. These polymers may be block, random, or alternating copolymers.

In embodiments, resins for use in the dispersion utilized to form the photogenerating layer possess hydroxyl functional groups. In other embodiments, the film forming resins possess carboxyl groups. Film forming resins which may be utilized in the dispersion forming the photogenerating layer may also include, for example, terpolymers and tetrapolymers.

Suitable terpolymers which may be utilized as the resin include the reaction product of vinyl chloride, vinyl acetate and maleic acid. In one embodiment, the terpolymer may be formed from a reaction mixture having from about 80 percent to about 87 percent by weight vinyl chloride, from about 12 percent to about 18 percent by weight vinyl acetate and up to about 2 percent by weight maleic acid, in embodiments from about 0.5 percent to about 2 percent by weight maleic acid, based on the total weight of the reactants for the terpolymer. When the proportion of maleic acid exceeds about 2 weight percent, high dark decay can occur and charging becomes unacceptable. A proportion of maleic acid of less than about 0.5 weight percent adversely affects the quality of the dispersion of photogenerating component particles in the coating composition.

In embodiments, the polymer may be a terpolymer represented by the following formula:

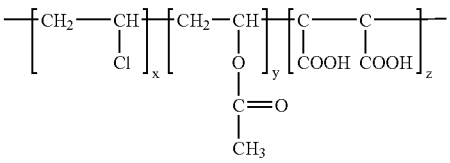

wherein x is the proportion of the terpolymer derived from a reaction mixture having for example, from about 80 percent to about 87 percent by weight vinyl chloride, i.e., x is, for example, about 80 percent to about 87 percent by weight of the terpolymer;

y is the proportion of the terpolymer derived from a reaction mixture having, for example, from about 12 percent to about 18 percent by weight vinyl acetate, i.e., y is, for example, about 12 percent to about 18 percent by weight; and z is the proportion of the terpolymer derived from a reaction mixture having, for example, up to about 2 percent by weight maleic acid, i.e., z is, for example, up to about 2 percent by weight, in embodiments from about 0.5 percent to about 2 percent by weight, based on the total weight of the terpolymer. In embodiments, the groups x, y, and z represent the percentage of each segment of the terpolymer, which percentage totals about 100 percent.

In other embodiments, the polymer may be a terpolymer represented by the following formula:

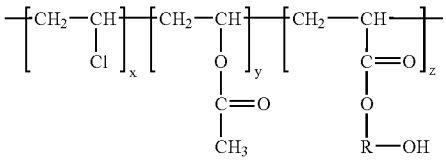

wherein R is an alkyl group containing about 2 to about 12 carbon atoms, in embodiments from about 2 to about 10 carbon atoms, and more specifically from about 2 to about 6 carbon atoms;

x is the proportion of the terpolymer derived from a reaction mixture having, for example, from about 80 percent to about 85 percent by weight vinyl chloride;

y is the proportion of the terpolymer derived from a reaction mixture having, for example, from about 3 percent to about 10 percent by weight vinyl acetate; and z is the proportion of the terpolymer derived from a reaction mixture having, for example, from about 5 percent to about 17 percent by weight hydroxyalkyl acrylate, based on the total weight of the terpolymer. In embodiments, the groups x, y, and z represent the percentage of each segment of the terpolymer, which percentage totals about 100 percent.

Some suitable film forming terpolymers are commercially available and include, for example, VAGF resin, a polymeric reaction product of 81 weight percent vinyl chloride, 4 weight percent vinyl acetate and 15 weight percent hydroxyethyl acrylate having a weight average molecular weight of about 33,000 (available from Union Carbide Co.); VMCH resin, a terpolymer reaction product of 86 weight percent vinyl chloride, 13 weight percent vinyl acetate and 1 weight percent maleic acid having a weight average molecular weight of about 27,000 (available from Dow Chemical Co.); VMCC resin, a terpolymer reaction product of 83 weight percent vinyl chloride, 16 weight percent vinyl acetate and 1 weight percent maleic acid having a weight average molecular weight of about 19,000 (available from Dow Chemical Co.); VMCA resin, a terpolymer reaction product of 81 weight percent vinyl chloride, 17 weight percent vinyl acetate and 2 weight percent maleic acid having a weight average molecular weight of about 15,000 (available from Dow Chemical Co.), and the like. Satisfactory results may be achieved when the terpolymer is a solvent soluble polymer having a weight average molecular weight of at least about 10,000. In embodiments, the terpolymer has a weight average molecular weight from about 10,000 to about 50,000. When the molecular weight is below about 10,000, poor film forming properties and undesirable dispersion characteristics can be encountered. A molecular weight greater than about 50,000 can be acceptable if the terpolymer remains solvent soluble. In embodiments, a stable Newtonian dispersion for forming a photogenerating layer can be obtained by using VMCH terpolymer from Dow Chemical Co. as the resin material.

Where utilized, the tetrapolymer may be represented by the following formula:

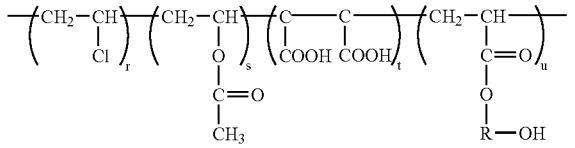

wherein R is an alkyl group of, for example, from about 2 to about 12 carbon atoms, in embodiments from about 2 to about 10 carbon atoms, and more specifically from about 2 to about 6 carbon atoms;

r is the proportion of the tetrapolymer derived from a reaction mixture having, for example, from about 80 percent to about 90 percent by weight vinyl chloride, i.e., r is, for example, about 80 percent to about 90 percent by weight;

s is the proportion of the tetrapolymer derived from a reaction mixture having, for example, from about 3 percent to about 18 percent by weight vinyl acetate, i.e., s is, for example, about 3 percent to about 18 percent by weight;

t is the proportion of the tetrapolymer derived from a reaction mixture having, for example, up to about 1 percent by weight maleic acid, i.e., t is, for example, up to about 1 percent by weight; and u is the proportion of the tetrapolymer derived from a reaction mixture having, for example, from about 6 percent to about 20 percent by weight hydroxyalkyl acrylate, i.e., u is, for example, about 6 percent to about 20 percent by weight, based on the total weight of the tetrapolymer. In embodiments, the groups r, s, t and u represent the percentage of each segment of the tetrapolymer, which percentage totals about 100 percent.

The alkyl component of the hydroxyalkyl acrylate reactant for the tetrapolymer described above may contain from about 2 to about 12 carbon atoms and includes, for example, ethyl, propyl, and the like. A proportion of hydroxyalkyl acrylate reactant of less than about 6 percent may adversely affect the quality of the dispersion. After the film forming resin is formed, the polymer may include a carbonyl hydroxyl copolymer having a hydroxyl content up to about 5 weight percent, based on the total weight of the tetrapolymer.

Some suitable tetrapolymers which may be utilized as the resin are commercially available and include, for example, UCARMAG™ 527 resin, (available from Dow Chemical Co.) which is a polymeric reaction product of 82 weight percent vinyl chloride, 4 weight percent vinyl acetate, 13.6 weight percent hydroxyethyl acrylate, and 0.4 weight percent maleic acid. In embodiments, these tetrapolymers have a weight average molecular weight of between about 20,000 and about 50,000. In embodiments satisfactory results may be achieved when the tetrapolymer is a solvent soluble polymer having a weight average molecular weight of about 35,000. When the molecular weight is below about 20,000, poor film forming properties and undesirable dispersion characteristics can be encountered.

In embodiments, a single resin may be utilized to form a dispersion of the present disclosure. A mixture of more than one of the above resins may also be used to form a dispersion of the present disclosure.

The resin may be present in the dispersion utilized to form a photogenerating layer in an amount from about 15 percent to about 95 percent by weight of the total solids of the dispersion and, in embodiments, from about 20 percent to about 80 percent by weight of the dispersion, although the relative amounts can be outside these ranges.

Suitable photogenerating components which may be added to the dispersion include known photogenerating pigments, such as metal phthalocyanines, metal free phthalocyanines, alkylhydroxyl gallium phthalocyanine, hydroxygallium phthalocyanines, perylenes, especially bis (benzimidazo)perylenes, titanyl phthalocyanines, and the like. In embodiments, vanadyl phthalocyanines, chlorogallium phthalocyanines, Type V hydroxygallium phthalocyanines, and inorganic components such as selenium, selenium alloys, and trigonal selenium may be utilized as the photogenerating component.

In embodiments, hydroxygallium phthalocyanine (HOGaPc) is utilized as the photogenerating component in the photogenerating layer. U.S. Pat. Nos. 5,521,306 and 5,473,064 describe HOGaPc and processes to prepare Type V hydroxygallium phthalocyanine. HOGaPc is most responsive at a range of, for example, about 550 nanometers to about 880 nanometers and is generally unresponsive to the light spectrum below about 500 nanometers. Wavelengths for photogeneration may be between 600 nanometers and 850 nanometers and may include a broadband between the two wavelengths.

The photogenerating component may be present in the dispersion in any suitable or desired amounts such that the resulting photogenerating layer prepared therefrom possesses the desired level of photogenerating component. The photogenerating component may be present in the dispersion, and thus the photogenerating layer, in an amount of from about 5 percent to about 85 percent by weight of the dispersion and, in embodiments, from about 20 percent to about 80 percent by weight of the dispersion.

Any suitable low boiling point solvents may be employed to form the dispersion of the present disclosure. A low boiling point solvent refers to, for example, a solvent having a boiling point between about 35° C. and about 100° C., in embodiments from about 38° C. to about 85° C. Low boiling point solvents include, for example, alkylene halides, alkylketones, alcohols, ethers, esters, and mixtures thereof. Specific examples of suitable solvents include tetrahydrofuran (THF), methylene chloride, acetone, methanol, ethanol, isopropyl alcohol, ethyl acetate, methylethyl ketone, 1,1,1-trichloroethane, 1,1,2-trichlororethane, chloroform, 1,2-dichloroethane and combinations thereof.

Due to the use of the low boiling point solvents, assisted drying of the deposited coating is not required.

In embodiments the low boiling point solvents may be combined with other solvents, including those having higher boiling points, to form the dispersion of the present disclosure. Suitable high boiling point solvents which may be combined with the low boiling point solvent to form the dispersion of the present disclosure include, for example, alkylene halides, alkylketones, alcohols, ethers, esters, aromatics and mixtures thereof. Specific examples of suitable solvents include n-butyl acetate (NBA), methyl isobutyl ketone (MIBK), cyclohexanone, toluene, xylene, monochlorobenzene, dichlorobenzene, 1,2,4 trichlorobenzene, mixtures of one or more of the foregoing solvents, and the like. Where a low boiling point solvent is combined with a higher boiling point solvent, for example, a solvent having a boiling point from about 100° C. to about 160° C., in embodiments from about 105° C. to about 130° C., drying may be utilized to form a photogenerating layer with the dispersion.

Some particularly useful solvents for use in forming the dispersion of the present disclosure include tetrahydrofuran, a mixture of tetrahydrofuran and n-butyl acetate, a mixture of tetrahydrofuran and methyl isobutyl ketone, and the like.

Where the low boiling point solvent utilized to form the dispersion of the present disclosure is combined with a high boiling point solvent, the ratio of low boiling point solvent to high boiling point solvent can be from about 100:0 to about 5:95, in embodiments from about 95:5 to about 25:75.

In embodiments, resins containing carboxyl functional groups, such as UCARMAG™ 527 (about 0.4% carboxyl), VMCH (about 1% carboxyl), VMCC (about 1% carboxyl), and VMCA (about 2% carboxyl) may be used to produce dispersions having Newtonian rheology in tetrahydrofuran and co-solvent systems of tetrahydrofuran with higher boiling point solvents such as n-butyl acetate and methyl isobutyl ketone. In one embodiment, diluting a dispersion of HOGaPc/UCARMAG™ 527/THF with n-butyl acetate or methyl isobutyl ketone results in coatings that may be applied over a wide range of temperatures, without the need for further drying.

Any suitable technique may be utilized to disperse the photogenerating component particles in the resin or resins dissolved in a suitable low boiling point solvent. The dispersion containing the photogenerating component may be formed by any suitable technique using, for example, attritors, ball mills, DYNOMILL® bead mills (from Glen Mills, Inc.), paint shakers, homogenizers, microfluidizers, CAVIPRO™ shear processors (from Five Star Technologies, Ltd.), mechanical stirrers, in-line mixers, or by any other suitable milling techniques.

In embodiments, dispersion techniques which may be utilized include, for example, ball milling, roll milling, milling in vertical or horizontal attritors, sand milling, and the like. The solids content of the mixture being milled can be selected from a wide range of concentrations. Milling times using a ball roll mill may be between about 1 hour and about 6 days, in embodiments from about 1.5 hours to about 24 hours. If desired, the photogenerating component with or without resin may be milled in the absence of solvent prior to forming the final coating dispersion.

Any suitable and conventional technique may be utilized to apply the dispersion of the present disclosure to form a photogenerating layer on another layer of a photoreceptor. Coating techniques include dip coating, roll coating, spray coating, slot coating, slide coating, die coating, rotary atomizers, and the like. The coating techniques may use a wide concentration of solids. In embodiments, the solids content may be from about 2 percent by weight to about 10 percent by weight based on the total weight of the dispersion. The expression "solids content" refers to the total weight of the photogenerating component particle and resin components of the coating dispersion. These solids concentrations are useful in dip coating, roll coating, spray coating, slot coating, slide coating, die coating, and the like. Generally, a more concentrated coating dispersion may be used for roll coating.

A conventional technique for coating cylindrical or drum shaped photoreceptor substrates to form photogenerating layers involves dipping the substrates in coating baths. Newtonian dispersions are preferred for dip coating since uniform results in the photogenerating layer are more likely to occur. In embodiments, the dispersion of the present disclosure may be a Newtonian dispersion applied to a cylindrical or drum shaped photoreceptor by dip coating.

Flexible photoreceptor belts may be fabricated by depositing the various layers of photoactive coatings onto long webs which are thereafter cut into sheets. Photogenerating layers are often applied to belts by slot coating, slide coating, die coating and the like, of a non-Newtonian dispersion. In embodiments, the dispersion of the present disclosure may be either a Newtonian or a non-Newtonian dispersion applied to a belt shaped photoreceptor by die coating or roll coating, and the like.

A solvent may be added to a dispersion of the present disclosure after it has been prepared to adjust the weight % of photogenerating component therein. The process of diluting an initially formed dispersion, sometimes referred to herein as a millbase, to obtain the desired amount of photogenerating component for formation of a photogenerating layer is sometimes referred to herein as "let down". For example, a low boiling point solvent described above may be utilized to let down the millbase to obtain the desired ratio of photogenerating component to resin. In embodiments, a high boiling point solvent described above may be utilized to let down the millbase to obtain the desired ratio of photogenerating component to resin, or combinations of solvents may be used.

In embodiments, a millbase of a photogenerating component and film forming resin may be prepared in a low boiling point solvent such as tetrahydrofuran, which may then be diluted with a second high boiling point solvent such as n-butyl acetate or methyl isobutyl ketone to produce a dispersion of the present disclosure having the desired level of photogenerating component. The dispersion may be applied over a wide range of temperatures, in embodiments from about 10° C. to about 40° C., without further drying.

Thus, a Newtonian dispersion may be prepared in a low boiling point solvent, and the solids content adjusted as necessary with additional solvent to maintain a Newtonian dispersion for application to a drum photoreceptor by dip coating. Similarly, the same initial Newtonian dispersion may be let down with a different solvent to obtain either a Newtonian or a non-Newtonian dispersion having the desired solids content for application to a belt photoreceptor by die or roll coating techniques.

The photogenerating layer containing photoconductive compositions and the resinous resin material generally can have a thickness from about 0.05 microns to about 10 microns or more, in embodiments from about 0.1 microns to about 5 microns, and in embodiments from about 0.3 microns to about 3 microns, although the thickness can be outside these ranges. The photogenerating layer thickness is related to the relative amounts of photogenerating component and resin, with the photogenerating component often being present in amounts from about 5 to about 80 percent by weight. Higher resin content compositions generally require thicker layers for photogeneration. Generally, it may be desirable to provide this layer in a thickness sufficient to absorb about 90 percent or more of the incident radiation which is directed upon it in the imagewise or printing exposure step. The maximum thickness of this layer depends upon factors such as mechanical considerations, the specific photogenerating component selected, the thicknesses of the other layers, and whether a flexible photoconductive imaging member is desired.

The dispersions of the present disclosure may be utilized to form photogenerating layers in conjunction with any known configuration for photoreceptors within the purview of those skilled in the art. Such photoreceptors include multi-layer photoreceptors described in U.S. Pat. Nos. 6,800,411, 6,824,940, 6,818,366, 6,790,573, and U.S. Patent Application Publication No. 20040115546, the entire contents of each of which are incorporated by reference herein. Photoreceptors may possess a charge generation layer (CGL), also referred to in embodiments as a photogenerating layer, and a charge transport layer (CTL). Other layers, including a substrate, an electrically conductive layer, a charge blocking or hole blocking layer, an adhesive layer, and/or an overcoat layer, may also be present in the photoreceptor.

Suitable substrates which may be utilized in forming a photoreceptor are known to those skilled in the art. The photoreceptor substrate may be opaque or substantially transparent, and may include any suitable organic or inorganic material having the requisite mechanical properties.

The substrate may be flexible, seamless, or rigid and may be of a number of different configurations such as, for example, a plate, a cylindrical drum, a scroll, a seamless flexible belt, and the like.

The thickness of the substrate layer may depend on numerous factors, including mechanical performance and economic considerations. For rigid substrates, the thickness of the substrate can be from about 0.5 millimeters to about 10 millimeters. For flexible substrates, the substrate thickness can be from about 65 to about 200 micrometers, in embodiments from about 75 to about 100 micrometers, for optimum flexibility and minimum stretch when cycled around small diameter rollers of, for example, 19 millimeter diameter. The entire substrate can be made of an electrically conductive material, or the electrically conductive material can be a coating on a polymeric substrate.

Substrate layers selected for the imaging members of the present disclosure, and which substrates can be opaque or substantially transparent, may include a layer of insulating material including inorganic or organic polymeric materials such as MYLAR® (a commercially available polymer from DuPont), MYLAR® containing titanium, a layer of an organic or inorganic material having a semiconductive surface layer, such as indium tin oxide or aluminum arranged thereon, or a conductive material inclusive of aluminum, chromium, nickel, brass, or the like.

Any suitable electrically conductive material can be employed with the substrate. Suitable electrically conductive materials include copper, brass, nickel, zinc, chromium, stainless steel, conductive plastics and rubbers, aluminum, semi-transparent aluminum, steel, cadmium, silver, gold, zirconium, niobium, tantalum, vanadium, hafnium, titanium, nickel, chromium, tungsten, molybdenum, and alloys thereof, paper rendered conductive by the inclusion of a suitable material therein, or through conditioning in a humid atmosphere to ensure the presence of sufficient water content to render the material conductive, indium, tin, metal oxides, including tin oxide and indium tin oxide, and the like.

After formation of an electrically conductive surface, a hole blocking layer may optionally be applied to the substrate layer. Generally, hole blocking layers (also referred to as electron transporting layers or charge injection blocking layers) allow holes from the imaging surface of the photoreceptor to migrate toward the conductive layer. Any suitable blocking layer capable of forming an electronic barrier to holes between the adjacent photogenerating layer and the underlying conductive layer of the substrate may be utilized. Blocking layers are well known and disclosed, for example, in U.S. Pat. Nos. 4,286,033, 4,291,110 and 4,338,387, the entire disclosures of each of which are incorporated herein by reference. Similarly, illustrated in U.S. Pat. Nos. 6,255,027, 6,177,219, and 6,156,468, the entire disclosures of each of which are incorporated herein by reference, are, for example, photoreceptors containing a hole blocking layer of a plurality of light scattering particles dispersed in a resin. For instance, Example 1 of U.S. Pat. No. 6,156,468 discloses a hole blocking layer of titanium dioxide dispersed in a linear phenolic resin.

Hole blocking layers utilized for negatively charged photoconductors may include, for example, polyamides including LUCKAMIDE® (a nylon type material derived from methoxymethyl-substituted polyamide commercially available from Dai Nippon Ink), hydroxy alkyl methacrylates, nylons, gelatin, hydroxyl alkyl cellulose, organopolyphosphazines, organosilanes, organotitanates, organozirconates, metal oxides of titanium, chromium, zinc, tin, silicon, and the like. In embodiments the hole blocking layer may include nitrogen containing siloxanes. Nitrogen containing siloxanes may be prepared from coating solutions containing a hydrolyzed silane. Hydrolyzable silanes include 3-aminopropyl triethoxy silane, N,N'-dimethyl 3-amino)propyl triethoxysilane, N,N-dimethylamino phenyl triethoxy silane, N-phenyl aminopropyl trimethoxy silane, trimethoxy silylpropyldiethylene triamine and mixtures thereof.

In embodiments, the hole blocking components may be combined with phenolic compounds, a phenolic resin, or a mixture of phenolic resins, for example 2 phenolic resins. Suitable phenolic compounds which may be utilized may contain at least two phenol groups, such as bisphenol A (4,4'-isopropylidenediphenol), bisphenol E (4,4'-ethylidenebisphenol), bisphenol F (bis(4-hydroxyphenyl)methane), bisphenol M (4,4'-(1,3-phenylenediisopropylidene)bisphenol), bisphenol P (4,4'-(1,4-phenylene diisopropylidene)bisphenol), bisphenol S (4,4'-sulfonyldiphenol), and bisphenol Z (4,4'-cyclohexylidenebisphenol), hexafluorobisphenol A (4,4'-(hexafluoro isopropylidene)diphenol), resorcinol, hydroxyquinone, catechin, and the like.

The hole blocking layer may be applied as a coating on a substrate or electrically conductive layer by any suitable conventional technique such as spraying, slot coating, slide coating, die coating, dip coating, draw bar coating, gravure coating, silk screening, air knife coating, reverse roll coating, vacuum deposition, chemical treatment, and the like. For convenience in obtaining thin layers, the blocking layers may be applied in the form of a dilute solution, with the solvent being removed after deposition of the coating by conventional techniques such as by vacuum, heating and the like. Drying of the deposited coating may be effected by any suitable conventional technique such as oven drying, infrared radiation drying, air drying and the like.

The blocking layer may be continuous and have a thickness of from about 0.01 microns to about 30 microns, in embodiments from about 0.1 microns to about 8 microns.

An optional adhesive layer may be applied to the hole blocking layer. Any suitable adhesive layer known in the art may be utilized including, but not limited to, polyesters, polyamides, poly(vinyl butyral), poly(vinyl alcohol), polyurethane and polyacrylonitrile. Where present, the adhesive layer may be, for example, of a thickness of from about 0.001 microns to about 1 micron. Optionally, the adhesive layer may contain effective suitable amounts, for example from about 1 weight percent to about 10 weight percent, of conductive and nonconductive particles, such as zinc oxide, titanium dioxide, silicon nitride, carbon black, and the like, to provide further desirable electrical and optical properties to the photoreceptor of the present disclosure. Conventional techniques for applying an adhesive layer coating mixture to the hole blocking layer include spraying, dip coating, roll coating, wire wound rod coating, gravure coating, die coating and the like. Drying of the deposited coating may be effected by any suitable conventional technique such as oven drying, infrared radiation drying, air drying and the like.

In embodiments the photoreceptor may also include a charge transport layer attached to the photogenerating layer. The charge transport layer may include a charge transport or hole transport molecule (HTM) dispersed in a polymeric material. These compounds may be added to polymeric materials which may otherwise be incapable of supporting the injection of photogenerated holes from the photogenerating layer and incapable of allowing the transport of these holes therethrough. The addition of these HTMs converts the polymeric material to a material capable of supporting the direction of photogenerated holes from the photogenerating layer and capable of allowing the transport of these holes through the charge transport layer in order to discharge the surface charge applied to the charge transport layer.

Suitable polymers for use in forming the charge transport layer are film forming resins known to those skilled in the art. Examples include those polymers utilized to form the photogenerating layer. In embodiments resin materials for use in forming the charge transport layer are electrically inactive resins including polycarbonate resins having a weight average molecular weight from about 20,000 to about 150,000, in embodiments from about 50,000 about 120,000. Electrically inactive resin materials which may be utilized in the charge transport layer include poly(4,4'-dipropylidene-diphenylene carbonate) with a weight average molecular weight of from about 35,000 to about 40,000, available as LEXAN® 145 from General Electric Company; poly(4,4'-propylidene-diphenylene carbonate) with a weight average molecular weight of from about 40,000 to about 45,000, available as LEXAN® 141 from the General Electric Company; a polycarbonate resin having a weight average molecular weight of from about 50,000 to about 100,000, available as MAKROLON® from Farbenfabricken Bayer A.G.; and a polycarbonate resin having a weight average molecular weight of from about 20,000 to about 50,000 available as MERLON® from Mobay Chemical Company. Methylene chloride solvent may be utilized in forming the charge transport layer coating mixture. In embodiments, electrically active polymeric resins can also be used, such as polysiloxane, poly(tetrahydrofuran), PVK, and the like.

Any suitable charge transporting or electrically active molecules known to those skilled in the art may be employed as HTMs in forming a charge transport layer on a photoreceptor. Suitable charge transport compounds include, for example, pyrazolines as described in U.S. Pat. Nos. 4,315,982, 4,278,746, 3,837,851, and 6,214,514, the entire disclosures of each of which are incorporated by reference herein. Suitable pyrazoline charge transport compounds include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Charge transport compounds also include aryl amines and diamines as described in U.S. Pat. Nos. 4,306,008, 4,304,829, 4,233,384, 4,115,116, 4,299,897, 4,265,990, 4,081,274 and 6,214,514, the entire disclosures of each of which are incorporated by reference herein. In embodiments, an aryl amine charge hole transporting component may be represented by:

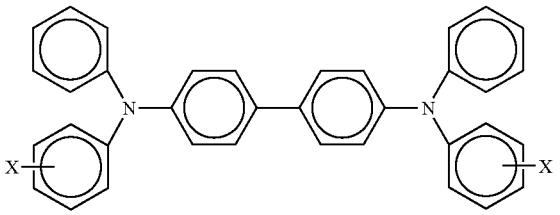

wherein X is selected from the group consisting of alkyl, halogen, alkoxy or mixtures thereof. In embodiments, the halogen is a chloride. Alkyl groups may contain, for example, from about 1 to about 10 carbon atoms and, in embodiments, from about 1 to about 5 carbon atoms. Examples of suitable aryl amines include, but are not limited to, N,N'-diphenyl-N,N'-bis(alkylphenyl)-1,1-biphenyl-4,4'-diamine, wherein the alkyl may be methyl, ethyl, propyl, butyl, hexyl, and the like; and N,N'-diphenyl-N,N'-bis(halophenyl)-1,1'-biphenyl-4,4'-diamine, wherein the halo may be a chloro, bromo, fluoro, and the like substituent.

Other suitable aryl amine transport compounds include N,N'-diphenyl-N,N'-bis(alkylphenyl)-[1,1'-biphenyl]-4,4'-diamine wherein the alkyl is linear such as for example, methyl, ethyl, propyl, n-butyl and the like, N,N'-diphenyl-N,N'-bis(3"-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

The weight ratio of the polymer resin to charge transport molecules in the resulting charge transport layer can be from about 30/70 to about 80/20, in embodiments from about 35/65 to about 75/25, in embodiments from about 40/60 to about 70/30.

Any suitable and conventional technique may be utilized to mix the polymer resin in combination with the hole transport material and apply same as a charge transport layer to a photoreceptor. In embodiments, it may be advantageous to add the polymer resin and hole transport material to a solvent to aid in formation of a charge transport layer and its application to a photoreceptor. Examples of solvents which may be utilized include aromatic hydrocarbons, aliphatic hydrocarbons, halogenated hydrocarbons, ethers, amides and the like, or mixtures thereof. In embodiments, a solvent such as cyclohexanone, cyclohexane, chlorobenzene, carbon tetrachloride, chloroform, methylene chloride, trichloroethylene, toluene, tetrahydrofuran, dioxane, dimethyl formamide, dimethyl acetamide and the like, may be utilized in various amounts. Suitable application techniques of the charge transport layer include spraying, slot or slide coating, dip coating, roll coating, wire wound rod coating, and the like. Drying of the deposited coating may be effected by any suitable conventional technique such as oven drying, infrared radiation drying, air drying and the like.

The thickness of the charge transport layer can be from about 2 micrometers and about 50 micrometers, in embodiments from about 10 micrometers to about 35 micrometers. The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer, where present, is in embodiments from about 2:1 to 200:1 and in some instances as great as 400:1.

The photogenerating layer, charge transport layer, and other layers may be applied in any suitable order to produce either positive or negative charging photoreceptors. For example, the photogenerating layer may be applied prior to the charge transport layer, as illustrated in U.S. Pat. No. 4,265,990, or the charge transport layer may be applied prior to the photogenerating layer, as illustrated in U.S. Pat. No. 4,346,158, the entire disclosures of each of which are incorporated by reference herein. When used in combination with a charge transport layer, the photogenerating layer may be sandwiched between a conductive surface and a charge transport layer or the charge transport layer may be sandwiched between a conductive surface and a photogenerating layer.

Optionally, an overcoat layer may be applied to the surface of a photoreceptor to improve resistance to abrasion. In some cases, an anti-curl back coating may be applied to the side of the substrate opposite the active layers of the photoreceptor (i.e., the CGL and CTL) to provide flatness and/or abrasion resistance where a web configuration photoreceptor is fabricated. These overcoating and anti-curl back coating layers are well known in the art and may include thermoplastic organic polymers or inorganic polymers that are electrically insulating or slightly semi-conductive. For example, overcoat layers may be fabricated from a dispersion including a particulate additive in a resin. Suitable particulate additives for overcoat layers include metal oxides including aluminum oxide, nonmetal oxides including silica or low surface energy polytetrafluoroethylene, and combinations thereof. Suitable resins include those described above as suitable for photogenerating layers and/or charge transport layers, for example, polyvinyl acetates, polyvinylbutyrals, polyvinylchlorides, vinylchloride and vinyl acetate copolymers, carboxyl-modified vinyl chloride/vinyl acetate copolymers, hydroxyl-modified vinyl chloride/vinyl acetate copolymers, carboxyl- and hydroxyl-modified vinyl chloride/vinyl acetate copolymers, polyvinyl alcohols, polycarbonates, polyesters, polyurethanes, polystyrenes, polybutadienes, polysulfones, polyarylethers, polyarylsulfones, polyethersulfones, polyethylenes, polypropylenes, polymethylpentenes, polyphenylene sulfides, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly-N-vinylpyrrolidinones, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and combinations thereof. Overcoatings may be continuous and have a thickness from about 0.5 micrometers to about 10 micrometers, in embodiments from about 2 micrometers to about 6 micrometers.

An example of an anti-curl backing layer is described in U.S. Pat. No. 4,654,284, the entire disclosure of which is incorporated herein by reference. In other embodiments, it may be desirable to coat the back of the substrate with an anticurl layer such as, for example, polycarbonate materials commercially available as MAKROLON® from Bayer Material Science. The thickness of anti-curl backing layers should be sufficient to substantially balance the total forces of the layer or layers on the opposite side of the supporting substrate layer. A thickness for an anti-curl backing layer may be from about 10 micrometers to about 100 micrometers, in embodiments from about 15 micrometers to about 50 micrometers, is a satisfactory range for flexible photoreceptors.

The dispersions of the present disclosure, when applied as a photogenerating layer to a photoreceptor, provide excellent photoinduced discharge characteristics, cyclic and environmental stability, and acceptable charge deficient spot levels arising from dark injection of charge carriers.

Processes of imaging, especially xerographic imaging and printing, are also encompassed by the present disclosure. More specifically, photoreceptors of the present disclosure can be selected for a number of different known imaging and printing processes including, for example, electrophotographic imaging processes, especially xerographic imaging and printing processes wherein charged latent images are rendered visible with toner compositions of an appropriate charge polarity. In embodiments, the imaging members may be sensitive in the wavelength region of, for example, from about 500 to about 900 nanometers, in embodiments from about 650 to about 850 nanometers; thus diode lasers can be selected as the light source. Moreover, the imaging members of this disclosure may be useful in color xerographic applications, particularly high-speed color copying and printing processes.

The following Examples are being submitted to illustrate embodiments of the present disclosure. These Examples are intended to be illustrative only and are not intended to limit the scope of the present disclosure. Also, parts and percentages are by weight unless otherwise indicated.

EXAMPLE 1

A dispersion was prepared by dissolving 4.5 grams of UCARMAG™ 527 (from Dow Chemical Co.) in 132 grams of 100% tetrahydrofuran (THF) and then adding 13.5 grams of hydroxygallium phthalocyanine (HOGaPc) Type V pigment (sometimes referred herein as Pc7). The UCARMAG™ 527 had a number average molecular weight of about 35,000. The dispersion was milled in an attritor mill with 1 mm diameter glass beads for about 2 hours. The dispersion was filtered to remove the beads and had a solids content of about 7.7 percent. Some of the dispersion was placed aside for Theological testing while the rest of the dispersion was diluted with THF to adjust the solids content to about 4.5 percent for coating.

A control sample dispersion was prepared by combining 13.5 grams of HOGaPc and 4.5 grams of poly(4,4'-diphenyl-1,1'-cyclohexane carbonate) having a molecular weight of about 20,000 (PCZ200, Mitsubishi, Chemicals) in 132 grams of 100% tetrahydrofuran (THF). The solids content of the control sample was adjusted to about 5 percent.

Rheological data for this dispersion was obtained by a Paar Physica rheometer with double-gap measuring system, the results of which are set forth in FIG. 1. As set forth in FIG. 1, Theological data of HOGaPc/UCARMAG527/THF (referred to in FIG. 1 as Pc7/UCAR527/THF) demonstrated that this dispersion was Newtonian up to 7.7% solids, as compared to the control PCZ sample dispersion (HOGaPc/PCZ200/THF) (referred to in FIG. 1 as Pc7/PCZ200/THF) which showed shear-thinning behavior at 5% solids.

EXAMPLE 2

Four photogenerating component dispersions were prepared by roll milling 3.0 grams of hydroxygallium phthalocyanine pigment and 2 grams of a film forming resin in 45 grams of tetrahydrofuran (THF) with 300 grams of ⅛" diameter stainless steel beads in a 4 ounce bottle for 8 hours. The resins utilized to prepare each dispersion were as follows:

(1) Resin was a polymer reaction product of 82 weight percent vinyl chloride, 4 weight percent vinyl acetate, 0.4 weight percent maleic acid and 13.6 weight percent hydroxyalkyl acrylate by weight of the polymer and having a number average molecular weight of about 35,000 (UCARMAG™ 527, available from Union Carbide Co.).

(2) Resin was a polymer reaction product of 86 weight percent vinyl chloride, 13 weight percent vinyl acetate, and 1 weight percent maleic acid by weight of the polymer and having a number average molecular weight of about 27,000 (VMCH, available from Union Carbide Co.).

(3) Resin was a polymer reaction product of 81 weight percent vinyl chloride, 17 weight percent vinyl acetate, and 2 weight percent maleic acid by weight of the polymer and having a number average molecular weight of about 15,000 (VMCA, available from Union Carbide Co.).

(4) Resin was poly(4,4'-diphenyl-1,1'-cyclohexane carbonate) with a molecular weight of about 20,000 (PCZ200, Mitsubishi Chemicals).

The dispersion was filtered to remove the beads and the solids content adjusted to 4.5 percent with THF for coating.

A Flow Visualization test was conducted for each dispersion to determine whether or not the dispersions were subject to clumping. Briefly, for the flow visualization test, the dispersion was allowed to flow through a small gap, 0.5 mil, where there was an obstruction in the flow path. The gap was formed by holding two pieces of micro slides together with two stainless steel shim strips having a thickness of 0.5 mil to confine the flow. The flow pattern after obstruction was one of the criteria for dispersion quality.

Figure 2:
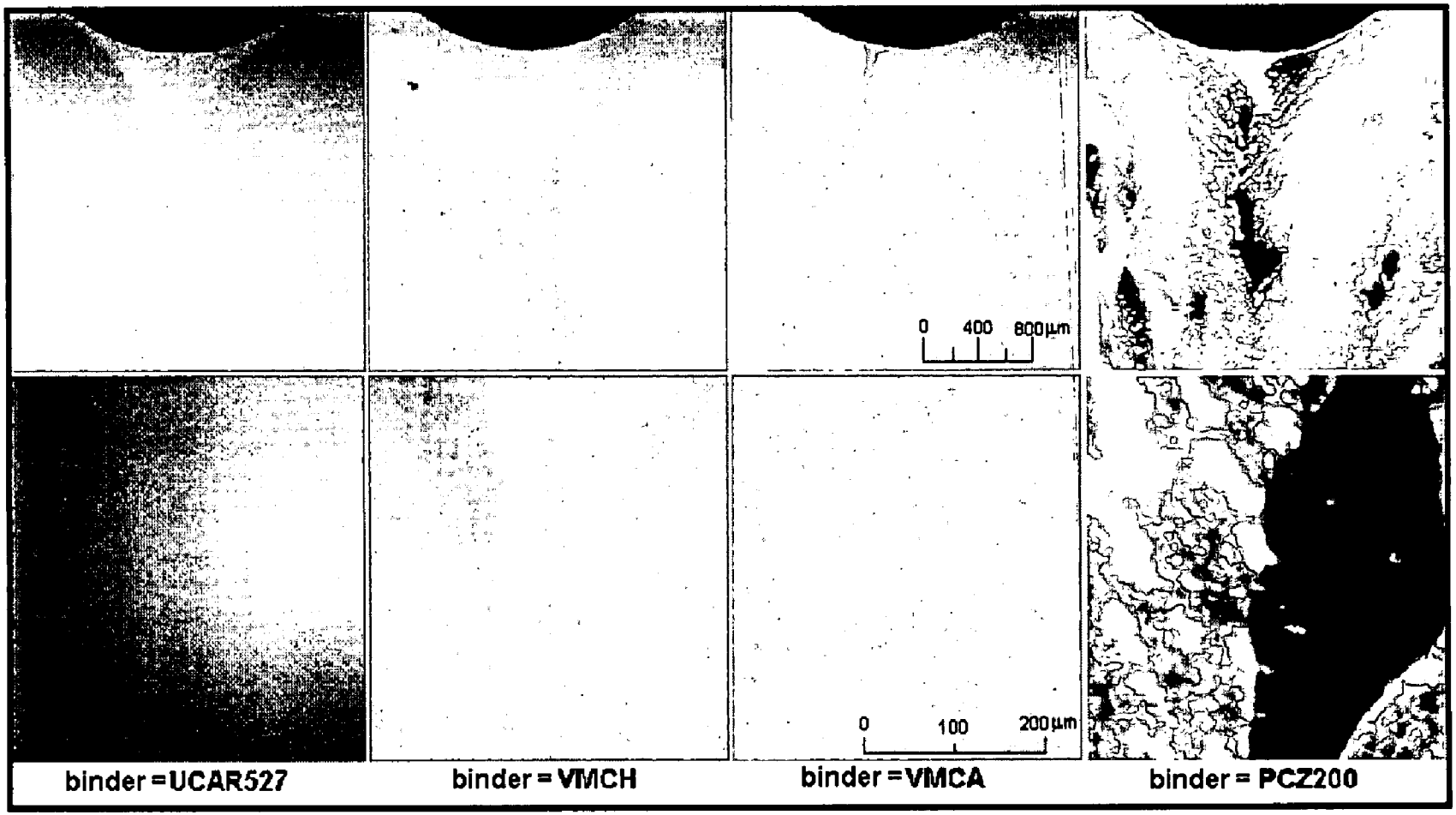
FIG. 2 are photographs depicting the results of flow visualization tests of these dispersions.

Photographs of the results of the Flow Visualization tests of these carboxyl-containing Newtonian dispersions are set forth in FIG. 2. As can be seen in FIG. 2, Newtonian dispersions containing carboxyl resin showed no aggregation as compared with the control (HOGaPc/PCZ200/THF), which did not contain a carboxyl functional group to stabilize the dispersion.

EXAMPLE 3

Three dispersions, 3-1, 3-2, and 3-3, were prepared following the procedures set forth above in Example 2 utilizing UCARMAG™ 527 as the resin, except that a CaviPro 300 processor (Five Star Technologies, Ltd.) was used for processing following the manufacturer's instructions, instead of roll milling. The actual solids content of the three dispersions was measured and then adjusted to 4.5 percent with THF for coating.

Two comparative example dispersions, CE-1 and CE-2, were prepared following the same methods and using the same materials, except the solvent utilized was NBA instead of THF.

Two comparative control dispersions, CC-1 and CC-2, were prepared following the procedures set forth above in Example 2 utilizing VMCH as the resin, except the dispersions were processed by a DYNOMILL® bead mill in a manufacturing scale rather than roll milling in lab scale, and the solvent utilized was NBA rather than THF.

Multi-layer photoreceptor devices were prepared with each dispersion on an aluminum drum. First, a 4-micron TiO2/SiO2/phenolic resin undercoat layer (UCL) was dip coated onto the drum utilizing the methods described in U.S. Pat. No. 6,156,468, the contents of which are incorporated by reference herein. Then, each dispersion described above was applied to the undercoat layer using a tsukiage coating method. The thickness of the photogenerating layer formed from each dispersion was adjusted by applying different pull rates and/or different dispersion concentrations to form photogenerating layers having thicknesses from about 0.2 micrometers to about 1.5 micrometers.

Finally, all the devices were overcoated in a dip coating process with a charge transport coating solution having a charge transport mixture of 14.4 grams of PCZ400 (poly(4,4'-diphenyl-1,1'-cyclohexane carbonate with a molecular weight of about 40,000, from Mitsubishi Chemicals), 9.6 grams of N,N'-diphenyl-N,N-bis(3-methyl phenyl)-1,1'-biphenyl-4,4'-diamine, 57.0 grams of THF, and 19.0 grams of monochlorobenzene. The applied charge transport coating was dried by a forced air oven at 135° C. for 45 minutes to form a layer having a thickness of 28 μm.

The resulting photoreceptor devices were electrically tested with a cyclic scanner set to obtain 100 charge-erase cycles immediately followed by an additional 100 cycles, sequences at 2 charge-erase cycles and 1 charge-expose-erase cycle, wherein the light intensity was incrementally increased with cycling to produce a photoinduced discharge curve from which the photosensitivity was measured. The scanner was equipped with a single wire corotron (5 centimeters wide) set to deposit 70 nanocoulombs/$cm^2$ of charge on the surface of the drum devices.

The devices were tested in the negative charging mode. The exposure light intensity was incrementally increased by means of regulating a series of neutral density filters, and the exposure wavelength was controlled by a band filter at 780±5 nanometers. The exposure light source was a 1,000 watt Xenon arc lamp white light source.

The drum was rotated at a speed of 90 rpm to produce a surface speed of 141.4 millimeters/second or a cycle time of 0.66 seconds. The xerographic simulation was carried out in an environmentally controlled light tight chamber at ambient conditions (50 percent relative humidity and 21° C.). The results of these tests are set forth below in Table 1, where $V_{zero}$ and $V_{low}$ are the initial voltage and the residual voltages after a given amount of light exposure, respectively; $V_{depl}$ represents the leakage voltage, or the inability of the device to hold a small amount of applied charge.

TABLE 1

| Sample # | $V_{depl}$ (V) | $V_{zero}$ | $V_{low}$ (2.8 ergs) | $V_{low}$ (13 ergs) | Photo-sensitivity (dV/dX) | Dark Decay (V/s) |
|---|---|---|---|---|---|---|
| 3-1 | 74.8 | 706.2 | 90.1 | 70.8 | −406.7 | 12.9 |
| 3-2 | 81.1 | 705.3 | 90.6 | 73.5 | −415.9 | 10.7 |
| 3-3 | 85.4 | 715.0 | 96.9 | 70.6 | −402.9 | 14.1 |
| CC-1 | 152.6 | 708.7 | 91.5 | 74.1 | −403.7 | 20.2 |
| CC-2 | 81.3 | 717.5 | 108.8 | 72.2 | −357.5 | 14.7 |
| CE-1 | 62.2 | 712.9 | 120.8 | 70.8 | −346.2 | 11.0 |
| CE-2 | 98.8 | 713.2 | 112.8 | 71.8 | −354.0 | 13.5 |

In Table 1, the dark decay of the photoreceptor was measured by monitoring the surface potential after applying a single charge cycle of 50 nanocoulombs/$cm^2$ while maintaining the photoreceptor in dark (without light exposure). Photosensitivity (dV/dx) was calculated from the initial discharge rate at low exposure intensity, determined at about 70 percent of the initial voltage or $V_{zero}$ (of about 0 to about 0.7 erg/$cm^2$ exposure). The voltage of the device ($V_{low}$) was measured at exposure levels of 2.8 erg/$cm^2$ to record the residual voltage obtained after the device is partially exposed and at 13 erg/$cm^2$ to record the residual voltage obtained when the device is fully exposed. The charge capacity was measured by applying increasing amounts of charge from about 2 to about 120 nC/$cm^2$, and monitoring the resulting voltage (with erase) to generate a charge-voltage curve. The low field voltage depletion was calculated from a linear regression of the charge-voltage curve, with the $V_{depl}$ voltage represented by the intercept at zero applied charge.

The sensitivity in samples 3-1, 3-2, and 3-3 were in good agreement with CC-1. While the sensitivity was well matched, the low field voltage depletion ($V_{depl}$) in samples 3-1, 3-2 and 3-3 was nearly 50% less than CC-1. Consistent with the lower depletion was the commensurate decrease in the rate of dark decay, which was 25-50% lower in samples 3-1, 3-2, and 3-3 than in CC-1. These results indicated much improved capacitive charging in the devices prepared with the THF based photogenerating layer of the present disclosure.

The excellent agreement in $V_{low}$ measured at 2.8 and 13 ergs demonstrated that the improvement in capacitive charging for samples 3-1, 3-2 and 3-3 was equivalent to the performance of CC-1 and did not result in the build-up of charge within the photoreceptor. In the THF based photogenerating layer, charge was efficiently transported out of the photoreceptor without impacting the characteristics of the photoinduced discharge curve (PIDC). The improved transport was enhanced by the slight intermixing of the charge transport layer with the photogenerating layer during the dip coating process, thereby enabling improved charge transfer to the charge transport layer.

In CC-2, CE-1 and CE-2, the low field depletion and dark decay values were close to those obtained in samples 3-1, 3-2 and 3-3, however the sensitivity was significantly lower. The increased sensitivity of samples 3-1, 3-2 and 3-3 was achieved while maintaining excellent photoinduced discharge characteristics including low dark discharge and low field depletion.

Multiple batches of the dispersions of the present disclosure were prepared to demonstrate the advantage of the THF based photogenerating layer as compared to the NBA system. While a higher sensitivity could be obtained in the NBA system as shown in CC-1, it was at the expense of other metrics, including low field depletion and dark decay. CC-2 showed that similar good behavior could be obtained with the same NBA/VMCH based photogenerating layer, but only by decreasing the sensitivity.

Similar results at the lower sensitivity were obtained with CE-1 and CE-2, which were also prepared with the NBA system.

The improvement of THF based photogenerating layers was demonstrated by the higher sensitivity the photoreceptors obtained while maintaining low dark decay, low depletion and improved chargeability.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A photoreceptor comprising a photogenerating layer of a photogenerating component, a low boiling point solvent, at least one high boiling point solvent, and a resin selected from the group consisting of terpolymers of the formula:

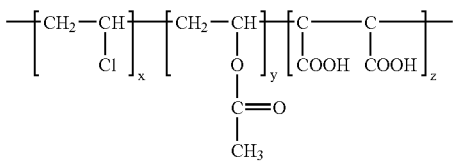

wherein x is from about 80 percent to about 87 percent by weight, y is from about 12 percent to about 18 percent by weight, and z is up to about 2 percent by weight of the terpolymer, wherein the total of x, y and z is equal to about 100 percent; and tetrapolymers of the formula:

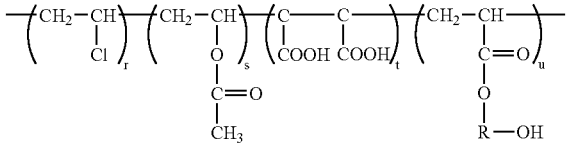

wherein R is an alkyl group containing from about 2 to about 12 carbon atoms, r is from about 80 percent to about 90 percent by weight, s is from about 3 percent to about 18 percent by weight, t is up to about 1 percent by weight, and u is from about 6 percent to about 20 percent by weight of the tetrapolymer, wherein the total of r, s, t and u is equal to about 100 percent;

and combinations thereof.

2. The photoreceptor of claim 1, wherein said low boiling point solvent has a boiling point of from about 35° C. to about 100° C.

3. The photoreceptor of claim 1, wherein said low boiling point solvent has a boiling point of from about 38° C. to about 85° C.

4. The photoreceptor of claim 1, wherein said low boiling point solvent is selected from the group consisting of alkylene halides, alkylketones, alcohols, ethers, esters, and mixtures thereof.

5. The photoreceptor of claim 1, wherein said low boiling point solvent is selected from the group consisting of tetrahydrofuran, methylene chloride, acetone, methanol, ethanol, isopropyl alcohol, ethyl acetate, methylethyl ketone, 1,1,1 -trichloroethane, 1,1,2-trichlororethane, chloroform, 1,2-dichloroethane, and mixtures thereof.

6. The photoreceptor of claim 1, wherein said high boiling point solvent has a boiling point from about 100° C. to about 160° C.

7. The photoreceptor of claim 1, wherein said high boiling point solvent is selected from the group consisting of alkylene halides, alkylketones, alcohols, ethers, esters, aromatics and mixtures thereof.

8. The photoreceptor of claim 1, wherein said high boiling point solvent is selected from the group consisting of n-butyl acetate, methyl isobutyl ketone, cyclohexanone, toluene, xylene, monochlorobenzene, dichlorobenzene, 1,2,4 trichlorobenzene, and mixtures thereof.

9. The photoreceptor of claim 1, wherein the resin comprises a terpolymer reaction product of vinyl chloride, vinyl acetate and maleic acid.

10. The photoreceptor of claim 1, wherein the resin comprises a tetrapolymer reaction product of vinyl chloride, vinyl acetate, maleic acid and a hydroxyalkyl acrylate.

11. The photoreceptor of claim 1, wherein the photogenerating component is selected from the group consisting of metal phthalocyanines, metal free phthalocyanines, alkylhydroxyl gallium phthalocyanines, hydroxygallium phthalocyanines, chlorogallium phthalocyanines, and perylenes.

12. The photoreceptor of claim 1, wherein the photogenerating component is selected from the group consisting of bis(benzimidazo)perylene, titanyl phthalocyanines, vanadyl phthalocyanines, selenium, selenium alloys, and trigonal selenium.

13. The photoreceptor of claim 1, wherein the photogenerating component is present in an amount from about 5 weight percent to about 85 weight percent of the total solids.

14. A method for fabricating a photogenerating layer of a photoreceptor comprising:

contacting a photogenerating component, a low boiling point solvent, at least one high boiling point solvent, and a resin selected from the group consisting of terpolymers of the formula:

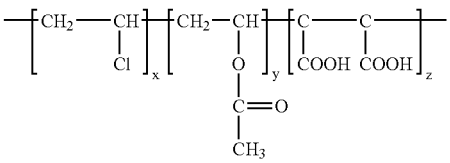

wherein x is from about 80 percent to about 87 percent by weight, y is from about 12 percent to about 18 percent by weight, and z is up to about 2 percent by weight of the terpolymer, wherein the total of x, y and z is equal to about 100 percent; and tetrapolymers of the formula:

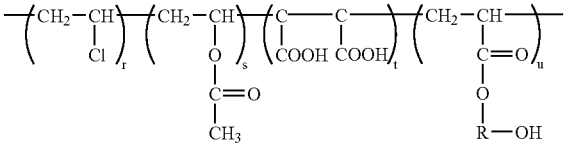

wherein R is an alkyl group containing from about 2 to about 12 carbon atoms, r is from about 80 percent to about 90 percent by weight, s is from about 3 percent to about 18 percent by weight, t is up to about 1 percent by weight, and u is from about 6 percent to about 20 percent by weight of the tetrapolymer, wherein the total of r, s, t and u is equal to about 100 percent, and combinations thereof to form a dispersion; and applying the dispersion to a substrate.

15. The method of claim 14, wherein said low boiling point solvent has a boiling point of from about 35° C. to about 100° C.

16. The method of claim 14, wherein the resin, photogenerating component and low boiling solvent are milled for a period of time from about 1 hour to about 6 days.

17. The method of claim 14, wherein the high boiling point solvent has a boiling point of from about 100° C. to about 160° C.

18. The method of claim 14, wherein the photogenerating component is present in the dispersion in an amount from about 5 weight percent to about 85 weight percent of the total solids and the resin is present in the composition in an amount from about 15 weight percent to about 95 weight percent of the total solids.

19. A photoreceptor comprising a photogenerating layer of about 15 weight percent to about 95 weight percent of a resin selected from the group consisting of terpolymers of the formula:

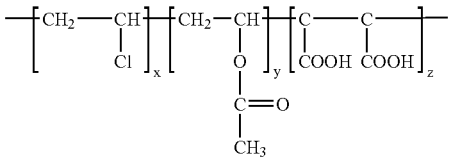

wherein x is from about 80 percent to about 87 percent by weight, y is from about 12 percent to about 18 percent by weight, z is up to about 2 percent by weight of the terpolymer, wherein the total of x, y and z is equal to about 100 percent; and tetrapolymers of the formula:

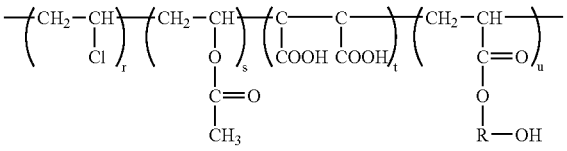

wherein R is an alkyl group containing from about 2 to about 12 carbon atoms, r is from about 80 percent to about 90 percent by weight, s is from about 3 percent to about 18 percent by weight, t is up to about 1 percent by weight, and u is from about 6 percent to about 20 percent by weight of the tetrapolymer, wherein the total of r, s, t and u is equal to about 100 percent, and combinations thereof;

about 5 weight percent to about 85 weight percent of a photogenerating component;

and a low boiling point solvent having a boiling point from about 35° C. to about 100° C. in combination with a high boiling point solvent having a boiling point from about 100° C. to about 160° C.

20. The photoreceptor of claim 19, wherein the low boiling point solvent is selected from the group consisting of tetrahydrofuran, methylene chloride, acetone, methanol, ethanol, isopropyl alcohol, ethyl acetate, methylethyl ketone, 1,1,1-trichioroethane, 1,1,2-trichlororethane, chloroform, 1,2-dichloroethane, and mixtures thereof.

21. The photoreceptor of claim 19, further comprising a charge transport layer, an optional substrate, an optional hole blocking layer, and an optional adhesive layer.

22. The photoreceptor of claim 21, wherein the thickness of the photogenerating layer is from about 0.05 microns to about 10 microns and the thickness of the charge transport layer is from about 2 micrometers to about 50 micrometers.

23. The photoreceptor of claim 21, wherein the charge transport layer comprises hole transport molecules selected from the group consisting of pyrazolines and aryl amines.

24. The photoreceptor of claim 21, wherein the charge transport layer comprises hole transport molecules comprising an aryl amine of the formula

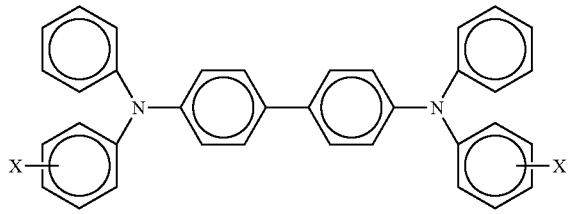

wherein X is selected from the group consisting of alkyl, halogen, alkoxy or mixtures thereof.

25. The photoreceptor of claim 21, wherein the charge transport layer comprises hole transport molecules selected from the group consisting of 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl) pyrazoline, and 1-phenyl-3-[p-diethylaminostyryl]-5-(p-diethylaminostyryl)pyrazoline.

26. A photoreceptor comprising aphotogenerating layer of a photogenerating component, a low boiling point solvent, at least one high boiling point solvent, and a resin comprising tetrapolymers of the formula:

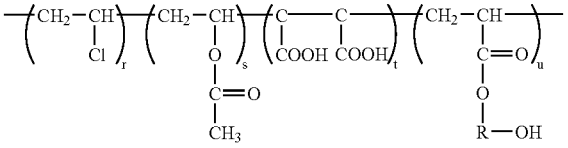

wherein R is an alkyl group containing from about 2 to about 12 carbon atoms, r is from about 80 percent to about 90 percent by weight, s is from about 3 percent to about 18 percent by weight, t is up to about 1 percent by weight, and u is from about 6 percent to about 20 percent by weight of the tetrapolymer, wherein the total of r, s, t and u is equal to about 100 percent;

and combinations thereof.

* * * * *